US009723701B2

(12) United States Patent
Han

(10) Patent No.: US 9,723,701 B2
(45) Date of Patent: Aug. 1, 2017

(54) LIGHT STRING

(71) Applicant: DONGGUAN FAYEUNG LIGHTING CO., LTD., Dongguan, Guangdong (CN)

(72) Inventor: Houhua Han, Hubei (CN)

(73) Assignee: DONGGUAN FAYEUNG LIGHTING CO., LTD., Dongguan (CN)

( * ) Notice: Subject to any disclaimer, the term of this patent is extended or adjusted under 35 U.S.C. 154(b) by 0 days.

(21) Appl. No.: 14/979,609

(22) Filed: Dec. 28, 2015

(65) Prior Publication Data

US 2016/0113098 A1 Apr. 21, 2016

Related U.S. Application Data

(63) Continuation-in-part of application No. 13/915,668, filed on Jun. 12, 2013, now Pat. No. 9,313,866.

(30) Foreign Application Priority Data

Apr. 8, 2013 (CN) ..... 2013 2 0169368 U
Apr. 18, 2013 (CN) ..... 2013 2 0197290 U

(51) Int. Cl.
*H05B 39/00* (2006.01)
*H05B 37/00* (2006.01)
*H05B 33/08* (2006.01)

(52) U.S. Cl.
CPC ..... *H05B 39/00* (2013.01); *H05B 33/0803* (2013.01); *H05B 33/0809* (2013.01); *H05B 37/00* (2013.01)

(58) Field of Classification Search
CPC .... H05B 39/00; H05B 37/00; H05B 33/0803; H05B 33/0815; F21S 4/10; F21Y 2101/02
USPC ..... 315/187, 185 S, 185 R, 192, 312, 188, 315/291; 362/234, 227, 253, 249.14, 362/249.19
See application file for complete search history.

(56) References Cited

U.S. PATENT DOCUMENTS 4,906,901 A * 3/1990 Carroll ..... H05B 39/045 315/210
8,324,820 B2 12/2012 Janning
9,035,559 B2 * 5/2015 Han ..... F21S 4/001 315/168
9,232,586 B2 * 1/2016 Hon ..... H05B 33/0815
9,247,627 B2 * 1/2016 Han ..... H05B 39/00
9,313,866 B2 * 4/2016 Han ..... H05B 37/00
2012/0161651 A1 6/2012 Hon
2014/0300286 A1 10/2014 Han
2015/0289351 A1 10/2015 Han
2016/0123566 A1 * 5/2016 Leung ..... F21V 19/006 362/249.06

* cited by examiner

*Primary Examiner* — Haissa Philogene

(57) ABSTRACT

A light string includes a plurality of lights and a plurality of non-polarity capacitor corresponding to the lights; wherein, the lights are electrically connected in series and to be powered by an AC power supply; each of the non-polarity capacitor is connected in parallel to a corresponding one of the lights. When the light string is powered on, the non-polarity capacitor is charged and absorbs the surge current which may occur. Thus, the voltage dropped on each light rises slowly and the lights are safe. The non-polarity capacitor also performs power compensation and electrical connection.

9 Claims, 5 Drawing Sheets

LIGHT STRING

CROSS-REFERENCE TO RELATED APPLICATIONS

The present application is a continuation-in-part application of U.S. application Ser. No. 13/915,668, filed on Jun. 12, 2013, which claims priority of Chinese Patent Application No. 201320169368.1, filed on Apr. 8, 2013 and Chinese Patent Application No. 201320197290.4, filed on Apr. 18, 2013, all of which are incorporated herein by reference.

BACKGROUND OF THE INVENTION

1. Field of the Invention

The invention relates to electric light strings.

2. Description of Related Art

Light strings are widely used for decorative purposes, especially for holiday lighting. Light strings refer to lights connected electrically in a series. Generally, a light string includes more than 10 lights, and is powered by mains electricity, such as 110V AC mains electricity. Thus, a voltage supplied on each light is 1.5V to 12V. When the light string is powered on, a surge current may be generated and may burn out the light bulb mounted in a lamp base. In the conventional light strings, when the filament of the light bulb fails and the bulb remains in the string, or when the bulb is removed from its socket for replacement, the closed path for the flow of electrical current is interrupted and the remainder of the lamps in the string will no longer be illuminated.

U.S. application Ser. No. 13/915,668, filed on Jun. 12, 2013, discloses a light string, which includes a number of lights. The lights are electrically connected in series and powered by an AC power supply. At least one capacitor is connected in parallel to one of the lights. Each light or a part of lights of the light string of the present invention is electrically connected in parallel to a capacitor. When the light string is powered on, the capacitor is charged and absorbs a surge current which may occur. Thus, the voltage dropped on each light rises slowly and the lights are safe. The capacitor also performs power compensation and electrical connection. When the filament of the light bulb fails and the bulb remains in the light string, or when the bulb is removed from its socket for replacement, the closed path for flow of electrical current is still closed.

U.S. application Ser. No. 14/747,584, filed on Jun. 23, 2015, discloses a light string, which includes a plurality of bulbs connected in series and powered by an AC power supply. Each bulb is connected in parallel with a capacitor, the capacitor is a polarized electrolytic capacitor, and capacitance of the capacitor is 47 uF-120 uF; a rated voltage of the capacitor is higher than a rated voltage of the bulb, and the rated voltage of the capacitor is 16V-100V; and when one bulb in the light string fails, the capacitor that is connected in parallel with the failed bulb operates normally; a positive plate and a negative plate of the capacitor connected in parallel with said each bulb are both covered with an oxide film insulating layer; when the light string is powered on, the oxide film insulating layer prevents breakdown and short circuit of the capacitor connected in parallel with said each bulb under the influence of a reverse voltage of the AC power.

BRIEF SUMMARY OF THE INVENTION

An object of the present invention is to provide an improved light string, when the filament of the light bulb fails and the bulb remains in the light string, or when the bulb is removed from its socket for replacement, the closed path for flow of electrical current is still closed, and the surge current can be absorbed.

A light string includes a plurality of lights and a plurality of non-polarity capacitor corresponding to the lights; wherein, the lights are electrically connected in series and to be powered by an AC power supply; each of the non-polarity capacitor is connected in parallel to a corresponding one of the lights.

Preferably, each of the lights includes a lamp, and the lamp is a tungsten filament lamp.

Preferably, a rated voltage of each of the non-polarity capacitor is within a range from about 2V to about 100V, and a capacitance of each of the non-polarity capacitor is within a range from 2 μF to 250 μF.

Preferably, the light string further comprises at least one capacitor series branch connected between the AC power supply and the plurality of lights, each capacitor series branch comprises a plurality of auxiliary capacitors, two ends of the capacitor series branch are respectively used for connecting to the two outputs of the AC power supply; the plurality of lights form a light series branch, the light series branch composed of the plurality of lights is connected in parallel to at least one of the auxiliary capacitors of the capacitor series branch.

Preferably, the light string further comprises a power plug, a corresponding end socket, and at least two electric wires electrically connecting the power plug and the end socket; a plurality of capacitor series branches are electrically connected in parallel to the electric wires, the auxiliary capacitors of the plurality of capacitor series branches are configured on at least one circuit board.

Preferably, the light series branch is detachably connected to the circuit board to be electrically connected to one of the capacitor series branches.

Preferably, the light string further comprises at least one connecting base each for receiving one of the at least one circuit board, each connecting base comprises a plurality of connecting sockets, each connecting socket is configured on the side wall of the connecting base and is electrically connected to one of the capacitor series branches.

Preferably, each connecting base defines two wire holes on the upper and lower surfaces respectively, the power plug and the end socket is configured on the two sides of the connecting base respectively.

Preferably, the connecting base is substantially annular and defines a gap therein to allow a post inserting a hole defined in the connecting base.

Preferably, the electric wires used in the light series branch are larger than 22 AWG, the electric wires electrically connecting the power plug and the end socket and the wires used in the capacitor series branches are smaller than 22 AWG.

Each light or a part of lights of the light string of the present invention is electrically connected in parallel to a non-polarity capacitor. When the light string is powered on, the non-polarity capacitor is charged and absorbs the surge current which may occur. Thus, the voltage dropped on each light rises slowly and the lights are safe. The non-polarity capacitor also performs power compensation and electrical connection. When a filament of a lamp fails and the lamp remains in the light string, or when the lamp is removed from its socket for replacement, the closed path for flow of electrical current is still closed.

Furthermore, in the above-described embodiments, since the light string adopts the non-polarity capacitors to absorb the surge current and perform power compensation and electrical connection, it is safer for use in AC circuits than existing light strings adopting polarity capacitors. Particular advantages of the use of the non-polarity capacitors will be described in the following detailed description of the invention.

BRIEF DESCRIPTION OF THE DRAWINGS

The foregoing and other exemplary purposes, aspects and advantages of the present invention will be better understood in principle form the following detailed description of one or more exemplary embodiments of the invention with reference to the drawings, in which.

DETAILED DESCRIPTION OF THE INVENTION

The invention will now be described in detail through several embodiments with reference to the accompanying drawings.

Figure 1:
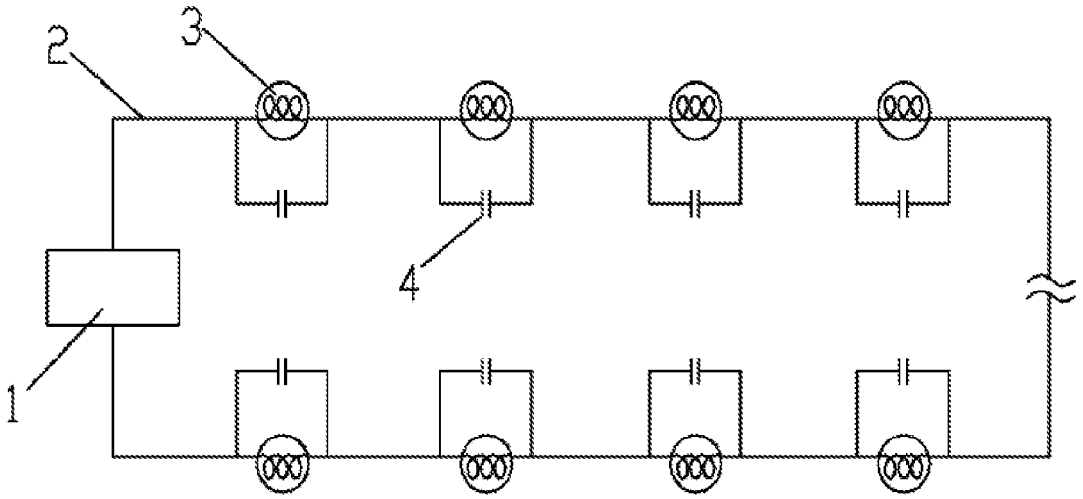
FIG. 1 is a part of the circuit diagram of a light string in accordance with an embodiment of the invention.

Referring to FIG. 1, a light string according to a preferred embodiment of the present invention mainly includes a plurality of lights 3 which are electrically connected in series by wires 2. The plurality of lights 3 may be electrically connected to an AC power supply via a power module 1. The AC power supply is preferably an AC mains electricity. Each of the light 3 includes a lamp, and the lamp is preferably a tungsten filament lamp. As a rated voltage of the lights 3 may be low, generally 1.5 volts to 12 volts, the light string usually includes more than 10 lights when connecting to 110V mains electricity.

In the embodiment, the light string further includes a plurality of capacitors 4, and each light 3 is electrically connected in parallel to a capacitor 4. The capacitor 4 is a non-polarity capacitor. A rated voltage of the capacitor 4 is preferably within a range from about 2V to about 100V, and a capacitance of the capacitor 4 is preferably within a range from 2 μF to 250 μF. When the light string is powered on, the capacitor 4 is charged and absorbs the surge current in the wires 2. Thus, the voltage dropped on each light 3 rises slowly and the lights 3 are safe. The capacitor 4 also performs power compensation and electrical connection. When the filament of the light bulb fails and the bulb remains in the light string, or when the bulb is removed from its socket for replacement, the closed path for flow of electrical current is still closed and allows the remaining lights to continue to operate. It is understandably, in other embodiments, only a part of the lights 3 in the light string is connected in parallel to a capacitor 4.

It is noted the capacitor 4 should be a non-polarity capacitor. In the drawings of the present invention, the symbols of the capacitors 4 represents that each capacitor 4 is a non-polarity capacitor, because there is no polarity mark labeled on the symbol of each capacitor 4, similar to the following symbol (1) representing a non-polarity capacitor according to the general drawing standards of circuit diagrams:

(1)

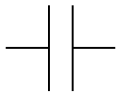

On the other hand, according to the general drawing standards of circuit diagrams, all of the following symbols (2)-(7) represent polarity capacitors, because obvious polarity marks are provided therein:

(2)

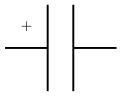

(3)

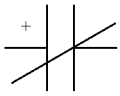

(4)

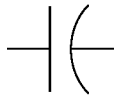

(5)

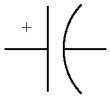

(6)

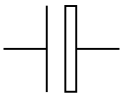

(7)

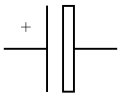

Therefore, it can be seen that in most existing technical solutions of light strings using capacitors, the capacitors are polarity capacitors, because the symbols representing capacitors in circuit diagrams of the existing technical solutions, for example, U.S. Pat. No. 8,324,820, are similar to at least one of the above symbols (2)-(7).

According to common sense, polarity capacitors are unavailable for light strings of the current claims powered by AC supplies. If a polarity capacitor is connected to an AC voltage, the polarity capacitor is prone to be broken down by an inverse voltage. Furthermore, in the existing technical solutions of light strings (e.g., the light string of U.S. Pat. No. 8,324,820), the polarity capacitors should be powered by a DC power supply, and when any lamp (e.g., an LED) is failed, the circuit will be kept being on by short-circuit of the capacitors. It can be inferred that the more the failed lights, the more the short-circuited capacitors, the higher the voltage and the greater the current, and thus more and more capacitors will be broken down and short-circuited, thereby forming a vicious cycle, which may damage the light string seriously. On the contrast, in the light string of this embodiment of the present invention, when any light 3 is failed, the non-polarity capacitor 4 connected in parallel with the failed light 3 can keep the circuit being on by means of power compensation, which will not increase but decrease the voltage in the circuit. Therefore, when failed lights 3 increases, the voltage and current in the circuit will not increase, and thus the light string is much safer than the light strings of the existing technical solutions (e.g., the light string of U.S. Pat. No. 8,324,820). Therefore, due to the non-polarity connectors 4 connected in parallel with the lights 3, the light string of this embodiment of the present application can achieve higher safety than the light strings of the existing technical solutions.

Furthermore, with respect to the present invention, the non-polarity capacitors 4 are actually used to construct a safe series voltage-reduction circuit. Only non-polarity capacitors with high capacitances, for example, the non-polarity capacitors 4 of this embodiment, can be suitable for working conditions of lights 3 (particularly tungsten filament lamps) electrically connected in series, and most routine capacitors are unable to be directly used in such a working condition. In this embodiment, the lights 3 are electrically connected in series, and each non-polarity capacitor 4 is electrically connected in parallel to one of the lights 3. In this way, all the non-polarity capacitors 4 are actually electrically connected in series. When alternating current passes through the non-polarity capacitors 4, the non-polarity capacitors 4 can be used to store electric power. If any one of the lights 3 malfunctions, due to the power compensation principle, the non-polarity capacitor 4 connected in parallel to the malfunctioning light 3 can provide electric power stored therein to other lights 3 and non-capacitors 4, so that other lights 3 can still work normally. Additionally, the non-polarity capacitor 4 connected in parallel to the malfunctioning light 3 is now connected in series with other lights 3, and the non-polarity capacitor 4 can reduce the voltage and current of other lights 3 due to its resistance, thereby protecting other lights 3 from being damaged by excessive voltage and/or current. It can be understood that the more malfunctioning lights 3, the more the non-polarity capacitors 4 connected in series with remained normal lights 3, the larger the resistance of the whole circuit, and thus the safer the whole circuit. Therefore, this embodiment can provide an effective excessive voltage protection. In some existing disclosures, such as US Patent Application US20120161651, non-polarity capacitors are used too, however, in these disclosures, despite the use of non-polarized capacitors, it is unable to solve the problem that one malfunctioning light source results in electrical disconnections of all other light sources connected in series with the malfunctioning light source. These existing disclosures are unable to provide excessive voltage protections similar to that of this embodiment, either.

Generally, each light 3 includes a bulb receiving the lamp and a socket for holding the bulb. The socket is configured electrical connectors (generally two sheets) for electrically connecting the pins of the bulb. The capacitor 4 may electrically connect to the electrical connectors to realize the parallel connection to the bulb.

Figure 2:
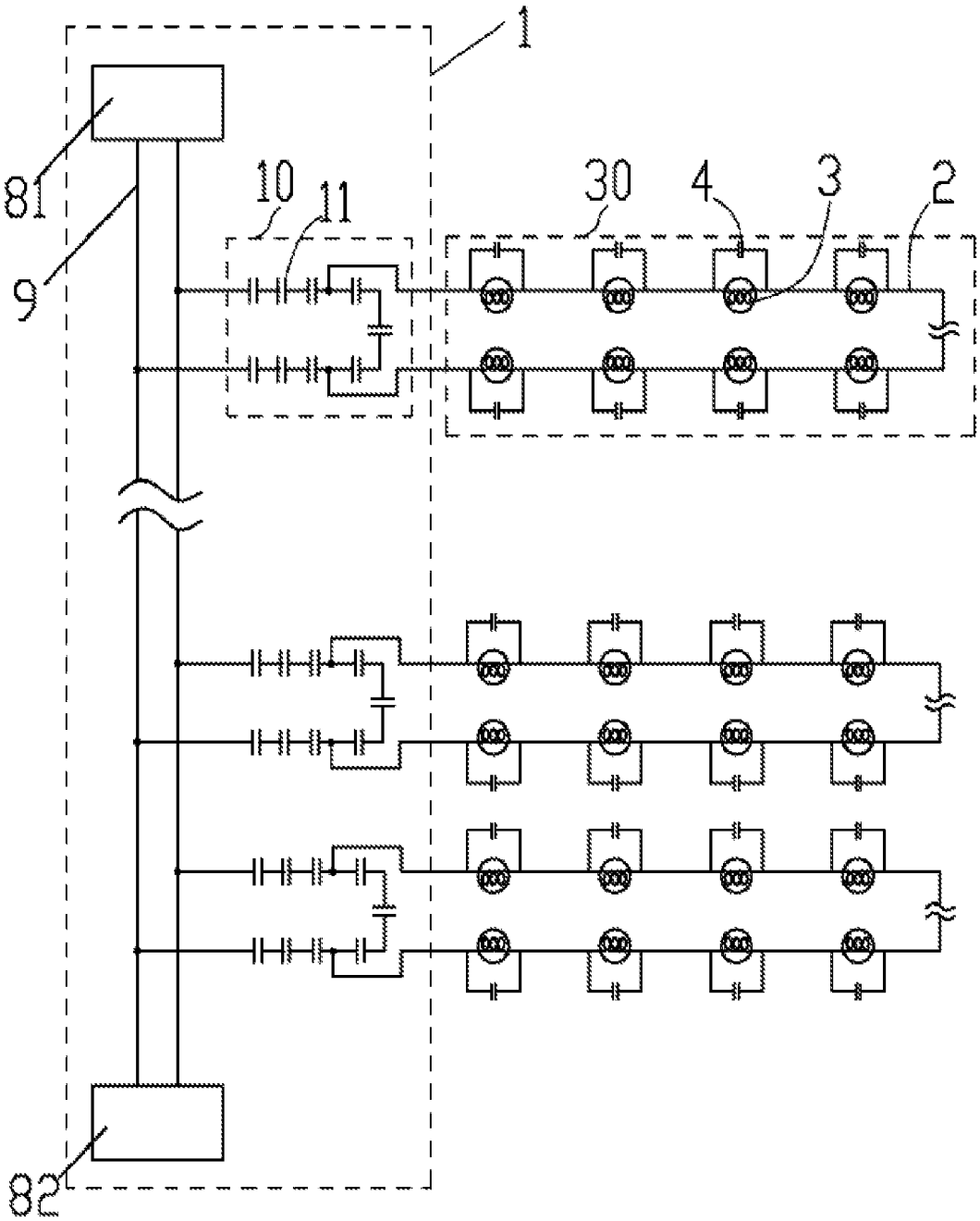
FIG. 2 is the circuit diagram of the light string in accordance with the embodiment of the invention shown in FIG. 1, the light string includes a power module.

Referring to FIG. 2, a complete circuit diagram of the light string according to the preferred embodiment of the present invention shown in FIG. 1 is illustrated. The light string includes a power module 1 and the plurality of lights 3. For clearly description, the series branch composed of the plurality of lights 3 is referred to as a light series branch 30.

Figure 3:
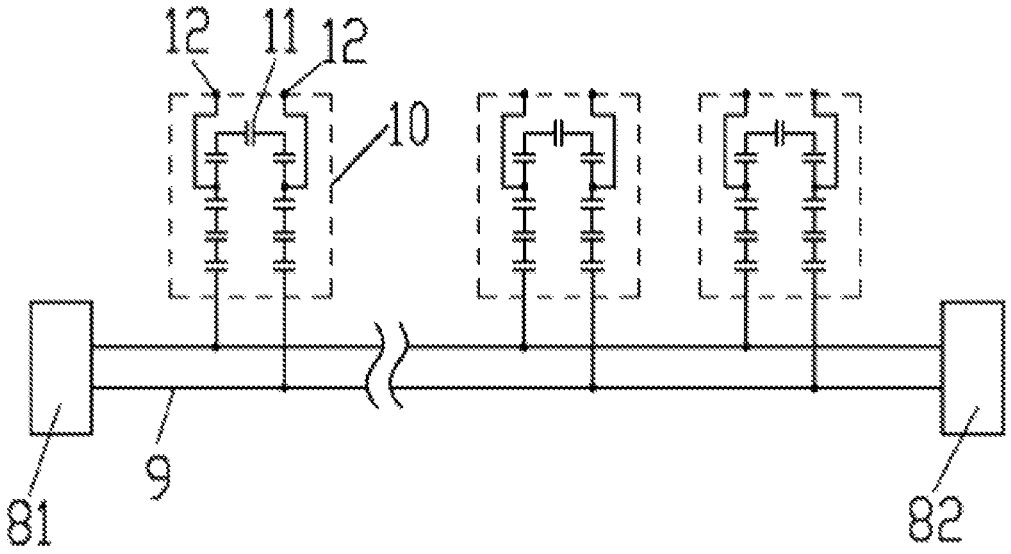
FIG. 3 is the circuit diagram of the power module of FIG. 2.

Please also refer to FIG. 3, the power module 1 mainly includes a power plug 81, a corresponding end socket 82, at least two electric wires (a fire wire, a null wire, and a grounding wire if there is three wires) 9 electrically connecting the power plug 81 and the end socket 82, and at least one capacitor series branch 10 electrically connected to the electric wires 9. In the embodiments, the power module 1 includes six capacitor series branches 10. The capacitor series branch 10 is used for receiving high voltage current from the AC power supply and supplying low voltage current to the light series branch 30.

Each capacitor series branch 10 includes a plurality of auxiliary capacitors 11. Preferably, each auxiliary capacitor 11 is a non-polarity capacitor. The light series branch 30 is electrically connected in parallel to at least one of the auxiliary capacitor 11 of the capacitor series branch 10. One capacitor series branch 10 corresponds to one light series branch 30. In the embodiment, the light series branch 30 is electrically connected in parallel to three auxiliary capacitors 11. For the light series branch 30, the capacitor series branch 10 performs as a transformer, it transforms the high voltage AC from wire 9 to a safe low voltage AC to the light series branch 30. Comparing with the traditional transformer composed of cores and windings, capacitor series branch 10 is safer, its structure is more simple and easy to turn a design into production level. More important, it is very cheap to modify the circuit in order to get different output. You only need to increase or reduce the auxiliary capacitors 11. Understandably, the power module 1 can be used in all the above embodiments. Preferably, the auxiliary capacitors 11 of the capacitor series branch 10 are fixed on a circuit board to facilitate the connection with the light series branch 30 and make the capacitor series branch 10 more strong.

The wires 2 used in the light series branches 30 are larger than 22 AWG (American wire gauge), the electric wires 9 electrically connecting the power plug 81 and the end socket 82 and the wires used in the capacitor series branches 10 are smaller than 22 AWG.

And furthermore, for facilitating packing and transporting, and for facilitating user to assemble and collocate the light string, the light series branches 30 are detachably connected to the circuit board via detachably electric connectors, such as plugs and sockets. In this way, during manufacture, each power module 1 may include a plurality of capacitor series branches 10. The consumers can buy corresponding number of light series branches 30 or less, more meet the demands of the consumers. If the consumers need more light series branches 30, they can buy more power modules 1 to form a bigger light string by connecting the end socket 82 of a power module to the power plug 81 of another power module. Referring to FIG. 10, the output terminal of each capacitor series branches 10 is configured a sockets 12.

Figure 4:
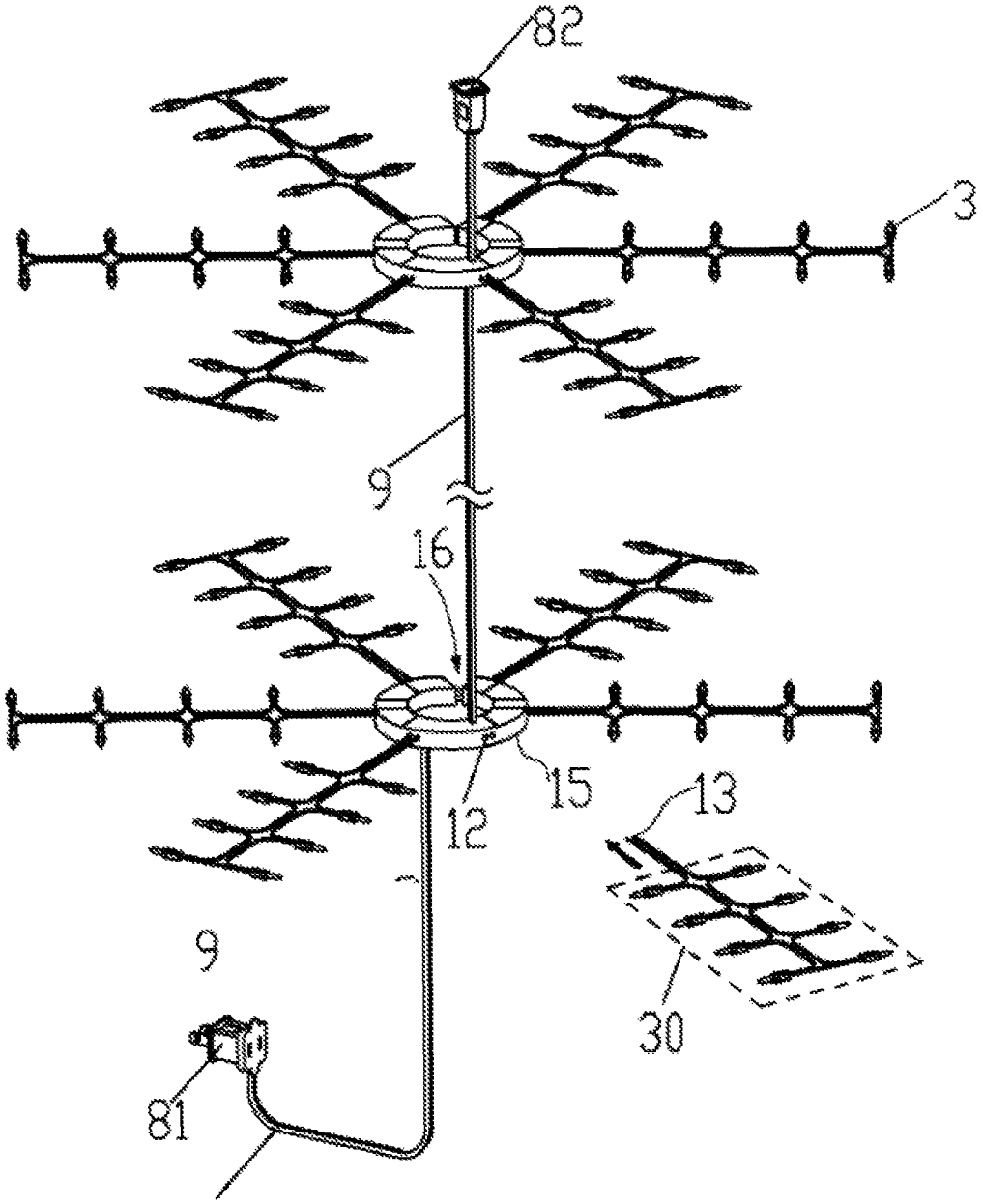
FIG. 4 is a perspective view of the light string in accordance with the embodiment of the invention shown in FIG. 1.

Please also refer to FIG. 4, in an exemplary embodiment, the light string further includes at least one connecting base 15. Each connecting base 15 is used for receiving one circuit board which is fixed at least one capacitor series branch 10. Accordingly, each connecting base 15 is configured a plurality of connecting sockets 12 in its side wall and the connecting sockets 12 are electrically connected to corresponding capacitor series branches 10. Each connecting base 15 defines two wire holes on the upper and lower surfaces respectively. The wire 9 passes through the wire holes, and the power plug 81 and the end socket 82 are configured on the two sides of the connecting base respectively.

Figure 5:
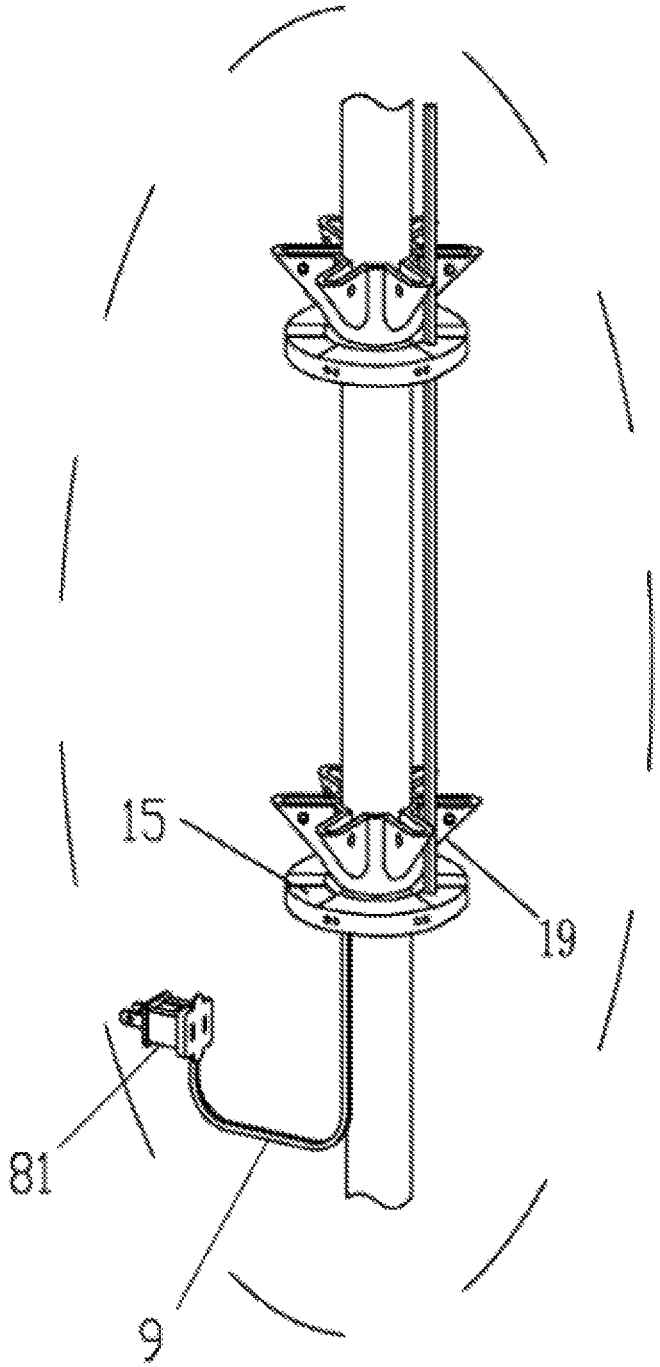
FIG. 5 is a perspective view showing a using condition of the light string with a post and a handle in accordance with the first embodiment of the invention shown in FIG. 1.

Please also refer to FIG. 5, in the embodiment, the connecting base 15 is substantially annular. The connecting sockets 12 is configured in the side wall of the connecting base 15. The two wire holes are defined on the upper and lower surfaces respectively. The connecting base 15 defines a gap 16 to allow a post inserting a hole defined in the connecting base 15. The light series branch 30 can be shaped like a tree branch, the input of the light series branch 30 connects a plug 13 which matches the connecting socket 12. In use, the user can clamp several connecting bases 15 to the trunk of the Christmas tree (or to other post) via the gap 16, just under the handle 19. Then, connecting the light series branches 30 to the connecting bases 15 to take the shape of umbrella. It is very convenient to assemble.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A light string, comprising: a plurality of lights, the lights being electrically connected in series and to be powered by an AC power supply; and a plurality of non-polarity capacitors corresponding to the lights, wherein each of the non-polarity capacitors is connected in parallel to a corresponding one of the lights, wherein a rated voltage of each of the non-polarity capacitor is within a range from about 2V to about 100V, and a capacitance of each of the non-polarity capacitor is within a range from 2 μF to 250 μF.

2. The light string of claim 1, wherein each of the lights includes a lamp, and the lamp is a tungsten filament lamp.

3. The light string of claim 1, wherein the light string further comprises at least one capacitor series branch connected between the AC power supply and the plurality of lights, each capacitor series branch comprises a plurality of auxiliary capacitors, two ends of the capacitor series branch are respectively used for connecting to the two outputs of the AC power supply; the plurality of lights form a light series branch, the light series branch composed of the plurality of lights is connected in parallel to at least one of the auxiliary capacitors of the capacitor series branch.

4. The light string of claim 3, wherein the light string further comprises a power plug, a corresponding end socket, and at least two electric wires electrically connecting the power plug and the end socket; a plurality of capacitor series branches are electrically connected in parallel to the electric wires, the auxiliary capacitors of the plurality of capacitor series branches are configured on at least one circuit board.

5. The light string of claim 4, wherein the light series branch is detachably connected to the circuit board to be electrically connected to one of the capacitor series branches.

6. The light string of claim 5, wherein the light string further comprises at least one connecting base each for receiving one of the at least one circuit board, each connecting base comprises a plurality of connecting sockets, each connecting socket is configured on the side wall of the connecting base and is electrically connected to one of the capacitor series branches.

7. The light string of claim 6, wherein each connecting base defines two wire holes on the upper and lower surfaces respectively, the power plug and the end socket is configured on the two sides of the connecting base respectively.

8. The light string of claim 7, wherein the connecting base is substantially annular and defines a gap therein to allow a post inserting a hole defined in the connecting base.

9. The light string of claim 8, wherein the electric wires used in the light series branch are larger than 22 AWG, the electric wires electrically connecting the power plug and the end socket and the wires used in the capacitor series branches are smaller than 22 AWG.

* * * * *